US012291765B2

(12) United States Patent
Ashizuka et al.

(10) Patent No.: US 12,291,765 B2
(45) Date of Patent: May 6, 2025

(54) ALLOYED STEEL POWDER FOR POWDER METALLURGY, IRON-BASED MIXED POWDER FOR POWDER METALLURGY, AND SINTERED BODY

(71) Applicant: JFE STEEL CORPORATION, Tokyo (JP)

(72) Inventors: Kohsuke Ashizuka, Tokyo (JP); Nao Nasu, Tokyo (JP); Takuya Takashita, Tokyo (JP); Shigeru Unami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 439 days.

(21) Appl. No.: 17/755,826

(22) PCT Filed: Nov. 12, 2020

(86) PCT No.: PCT/JP2020/042313
§ 371 (c)(1),
(2) Date: May 10, 2022

(87) PCT Pub. No.: WO2021/100613
PCT Pub. Date: May 27, 2021

(65) Prior Publication Data

US 2022/0380873 A1 Dec. 1, 2022

(30) Foreign Application Priority Data

Nov. 18, 2019 (JP) ..... 2019-208215
Nov. 18, 2019 (JP) ..... 2019-208219

(51) Int. Cl.

| | |
|---|---|
| ***C22C 38/22*** | (2006.01) |
| ***B22F 3/10*** | (2006.01) |
| ***C22C 38/04*** | (2006.01) |
| ***C22C 38/16*** | (2006.01) |
| ***C22C 38/20*** | (2006.01) |

(52) U.S. Cl.
CPC ..... *C22C 38/16* (2013.01); *B22F 3/10* (2013.01); *C22C 38/04* (2013.01); *C22C 38/20* (2013.01); *C22C 38/22* (2013.01); *B22F 2301/10* (2013.01); *B22F 2301/35* (2013.01); *B22F 2303/01* (2013.01)

(58) Field of Classification Search
None
See application file for complete search history.

(56) References Cited

U.S. PATENT DOCUMENTS

| | | | |
|---|---|---|---|
| 4,388,114 | A | 6/1983 | Suganuma et al. |
| 5,666,634 | A | 9/1997 | Unami et al. |
| 6,068,813 | A | 5/2000 | Semel |
| 7,341,689 | B2 | 3/2008 | Engstroem et al. |
| 8,734,561 | B2 | 5/2014 | Larsson |
| 2010/0154588 | A1 | 6/2010 | Berg et al. |
| 2010/0316521 | A1 | 12/2010 | Litstroem et al. |
| 2014/0286811 | A1 | 9/2014 | Ohmori et al. |
| 2018/0193908 | A1 | 7/2018 | Takashita et al. |
| 2018/0193911 | A1 | 7/2018 | Kobayashi et al. |
| 2021/0047713 | A1 | 2/2021 | Takashita et al. |
| 2021/0180164 | A1 | 6/2021 | Takashita et al. |

FOREIGN PATENT DOCUMENTS

| | | | |
|---|---|---|---|
| CA | 3084316 | A1 | 6/2019 |
| CN | 104073707 | A | 10/2014 |
| CN | 104827039 | A | 8/2015 |
| CN | 108025357 | A | 5/2018 |
| JP | 2003500538 | A | 1/2003 |
| JP | 2005530037 | A | 10/2005 |
| JP | 2010529302 | A | 8/2010 |
| JP | 2013508558 | A | 3/2013 |
| JP | 2015108195 | A | 6/2015 |
| WO | 2019111833 | A1 | 6/2019 |
| WO | 2019189012 | A1 | 10/2019 |

OTHER PUBLICATIONS

Jan. 19, 2021, International Search Report issued in the International Patent Application No. PCT/JP2020/042313.
Mar. 15, 2022, Notification of Reasons for Refusal issued by the Japan Patent Office in the corresponding Japanese Patent Application No. 2021-511006 with English language Concise Statement of Relevance.
Dec. 21, 2022, the Extended European Search Report issued by the European Patent Office in the corresponding European Patent Application No. 20891049.7.
Jan. 19, 2024, Office Action issued by the China National Intellectual Property Administration in the corresponding Chinese Patent Application No. 202080078565.5 with English language search report.

*Primary Examiner* — Anthony M Liang
(74) *Attorney, Agent, or Firm* — KENJA IP LAW PC

(57) ABSTRACT

Provided is an alloyed steel powder for powder metallurgy that has excellent compressibility and enables obtaining a sintered body having improved strength as sintered. An alloyed steel powder for powder metallurgy comprises: Cu: 2.0 mass % or more and 8.0 mass % or less; Mo: more than 0.50 mass % and 2.00 mass % or less; one or both of Mn: 0.1 mass % or more and 1.0 mass % or less and Cr: 0.3 mass % or more and 3.5 mass % or less; and a balance consisting of Fe and inevitable impurities, wherein the alloyed steel powder contains particulate oxide, and a total amount of Mn and Cr in the particulate oxide is 0.15 mass % or less with respect to 100 mass % of the alloyed steel powder, and a number ratio of particulate oxide in contact with Cu of FCC structure to the particulate oxide is 50% or more.

4 Claims, No Drawings

ALLOYED STEEL POWDER FOR POWDER METALLURGY, IRON-BASED MIXED POWDER FOR POWDER METALLURGY, AND SINTERED BODY

TECHNICAL FIELD

The present disclosure relates to an alloyed steel powder for powder metallurgy, an iron-based mixed powder for powder metallurgy, and a sintered body.

BACKGROUND

Powder metallurgical techniques enable producing parts having complex shapes in shapes (i.e. near net shapes) extremely close to product shapes, with high dimensional accuracy. Powder metallurgical techniques thus contribute to significantly reduced machining costs in production of parts. For this reason, powder metallurgical products are used as various machine parts in many fields. To cope with reduction in size and weight of parts and complication of parts, requirements for powder metallurgical techniques are further growing.

Against this backdrop, requirements for alloyed steel powders used in powder metallurgy are ever more sophisticated, and alloyed steel powders are required to have favorable compressibility and sintered bodies obtained by sintering alloyed steel powders are required to have excellent mechanical properties. There is also strong demand for reduction in production costs. There is thus demand for alloyed steel powders that can be produced by a conventional metallurgical powder production process with no need for additional steps and that do not need expensive alloy components such as Ni.

Methods proposed to improve the strength of sintered bodies include a method of mixing a steel powder with a specific metal powder to produce a mixed powder, a method of diffusion-bonding a specific metal powder to the surface of a steel powder, a method of using a steel powder and a graphite powder in combination, and a method of alloying a steel powder and a specific metal element to produce an alloyed steel powder.

For example, JP 2015-108195 A (PTL 1) proposes a steel powder alloyed with Cr and Mn, which is optionally mixed with a Cu powder.

JP 2005-530037 A (PTL 2) proposes a steel powder alloyed with Cr, Mo, and Mn, which is optionally mixed with at least one of a Cu powder and a Ni powder.

JP 2003-500538 A (PTL 3) proposes a mixed powder for powder metallurgy produced by mixing a steel powder alloyed with Mo with at least one of a Cu powder and a Ni powder.

JP 2010-529302 A (PTL 4) proposes an alloyed steel powder alloyed with Ni, Mo, and Mn.

JP 2013-508558 A (PTL 5) proposes a method of binding a graphite powder to an iron-based powder using a binder, with the iron-based powder being optionally alloyed with alloying elements such as Ni, Cr, Mo, and Mn.

CITATION LIST

Patent Literature

PTL 1: JP 2015-108195 A
PTL 2: JP 2005-530037 A

PTL 3: JP 2003-500538 A
PTL 4: JP 2010-529302 A
PTL 5: JP 2013-508558 A

SUMMARY

Technical Problem

Regarding PTL 1, the effect of improving the strength of a sintered body by Cr and Mn is limited even when a Cu powder or the like is added, and further improvement in strength is needed.

Regarding PTL 2, a small amount of Mo is used in addition to Cr and Mn, but the effect of improving the strength of a sintered body is limited even when at least one of a Cu powder and a Ni powder is added, and further improvement in strength is needed.

Regarding PTL 3, the effect of improving the strength of a sintered body by alloying with Mo is limited even when a Cu powder or the like is added, and further improvement in strength is needed.

Regarding PTL 4, the use of Ni requires high costs.

Regarding PTL 5, heat treatments such as carburizing, quenching, and tempering need to be performed after sintering, in order to improve the mechanical properties of a sintered body.

It could therefore be helpful to provide an alloyed steel powder for powder metallurgy that has excellent compressibility and enables obtaining a sintered body having improved strength as sintered (i.e. in a state of not being subjected to further heat treatment). Herein, "compressibility" means the density (compressed density) of a green compact obtained when compacting a powder with a given compacting pressure. Higher compressibility is more desirable.

It could also be helpful to provide an iron-based mixed powder for powder metallurgy containing the alloyed steel powder for powder metallurgy.

It could further be helpful to provide a sintered body using the alloyed steel powder for powder metallurgy or the iron-based mixed powder for powder metallurgy.

Solution to Problem

As a result of conducting intensive study, we discovered the following:

(1) An alloyed steel powder containing specific amounts of Cu, Mo, and one or both of Mn and Cr as alloying elements has excellent compressibility, and is effective in providing a sintered body having improved strength as sintered.

(2) Particulate oxide that forms inevitably in metallic microstructure in production of an alloyed steel powder or the like basically has high hardness, and accordingly can not only decrease the compressibility of the powder but also hinder element diffusion during sintering and thus decrease the strength of the sintered body significantly. By reducing the amounts of Mn oxide and Cr oxide which have particularly high hardness and causing Cu of soft FCC structure to precipitate so as to come into contact with the particulate oxide, the decrease in compressibility can be suppressed, and diffusion of Cu during sintering can facilitate the sintering.

The present disclosure is based on these discoveries. We thus provide:

[1] An alloyed steel powder for powder metallurgy, comprising: Cu: 2.0 mass % or more and 8.0 mass % or less; Mo: more than 0.50 mass % and 2.00 mass % or less; one or both of Mn: 0.1 mass % or more and 1.0 mass % or less and Cr:

0.3 mass % or more and 3.5 mass % or less; and a balance consisting of Fe and inevitable impurities, wherein the alloyed steel powder contains particulate oxide, and a total amount of Mn and Cr in the particulate oxide is 0.15 mass % or less with respect to 100 mass % of the alloyed steel powder, and a number ratio of particulate oxide in contact with Cu of FCC structure to the particulate oxide is 50% or more.

[2] An iron-based mixed powder for powder metallurgy, comprising: the alloyed steel powder for powder metallurgy according to [1]; and a metal powder, wherein the metal powder is one or both of a Cu powder: more than 0 mass % and 4 mass % or less and a Mo powder: more than 0 mass % and 4 mass % or less with respect to 100 mass % of the iron-based mixed powder for powder metallurgy.

[3] A sintered body using the alloyed steel powder for powder metallurgy according to [1] or the iron-based mixed powder for powder metallurgy according to [2].

Advantageous Effect

It is thus possible to provide an alloyed steel powder for powder metallurgy that has excellent compressibility and enables obtaining a sintered body having improved strength as sintered.

The alloyed steel powder for powder metallurgy does not contain Ni which requires high alloy costs and does not need any additional production step such as coating or plating, and therefore is advantageous cost-wise. Moreover, the alloyed steel powder for powder metallurgy is convenient because it can be produced by a conventional production process for powders for metallurgy.

It is also possible to provide an iron-based mixed powder for powder metallurgy that equally has excellent compressibility and enables obtaining a sintered body having improved strength as sintered.

DETAILED DESCRIPTION

One of the disclosed embodiments will be described in detail below.

[Alloyed Steel Powder for Powder Metallurgy]

An alloyed steel powder for powder metallurgy (hereafter also referred to as "alloyed steel powder") according to one of the disclosed embodiments is composed of an iron-based alloy containing Cu and Mo as essential components and containing one or both of Mn and Cr. Herein, "iron-based" means containing 50 mass % or more of Fe. "%" with regard to chemical compositions denotes "mass %" unless otherwise noted. The chemical composition of the alloyed steel powder for powder metallurgy is expressed with respect to 100 mass % of the alloyed steel powder for powder metallurgy.

Cu: 2.0% or More and 8.0% or Less

Cu is an element that improves hardenability, and is advantageous in terms of being less expensive than Ni. If the Cu content is less than 2.0%, the effect of improving hardenability by Cu is insufficient. Moreover, the content is not sufficient to cause Cu of FCC structure to precipitate so as to come into contact with particulate oxide. The Cu content is therefore 2.0% or more. In production of a sintered body, sintering is typically performed at about 1130° C. Based on the Fe—Cu-based phase diagram, if the Cu content is more than 8.0%, Cu precipitates into austenite phase. Cu precipitated during sintering is not effective in hardenability improvement, but remains as soft phase in the microstructure and can cause a decrease in mechanical properties. The Cu content is therefore 8.0% or less. By adding Cu in this range, the tensile strength can be improved sufficiently while suppressing a decrease in density. To achieve higher strength effectively, the Cu content is preferably 2.5% or more, and preferably 6.0% or less.

Mo: More than 0.50% and 2.00% or Less

Mo is an element that improves hardenability, and has a property of achieving sufficient hardenability improving effect even in a small amount as compared with Ni. If the Mo content is 0.50% or less, the effect of improving strength by Mo is insufficient. The Mo content is therefore more than 0.50%. If the Mo content is more than 2.00%, the compressibility of the alloyed steel powder decreases, as a result of which the compacting die tends to wear out. Besides, the effect of improving the strength of the sintered body by adding Mo is saturated. The Mo content is therefore 2.00% or less. To achieve higher strength effectively, the Mo content is preferably 1.00% or more, and preferably 1.50% or less.

One or Both of Mn: 0.1% or More and 1.0% or Less and Cr: 0.3% or More and 3.5% or Less The alloyed steel powder according to one of the disclosed embodiments contains one or both of Mn: 0.1% or more and 1.0% or less and Cr: 0.3% or more and 3.5% or less.

Mn is an element that improves hardenability, and has a property of achieving sufficient hardenability improving effect even in a small amount as compared with Ni. If the Mn content is less than 0.1%, the effect of improving strength by Mn is insufficient. Accordingly, in the case where the alloyed steel powder contains Mn, the Mn content is 0.1% or more. If the Mn content is more than 1.0%, a large amount of Mn oxide forms. Mn oxide serves as a fracture origin inside the sintered body, and causes a decrease in the strength of the sintered body. Moreover, if a large amount of Mn dissolves in the steel powder, the steel powder hardens due to the solid solution strengthening effect, and as a result the compressibility of the powder decreases. Accordingly, in the case where the alloyed steel powder contains Mn, the Mn content is 1.0% or less. To achieve higher compressibility and sintered body strength effectively, the Mn content is preferably 0.2% or more, and preferably 0.6% or less.

Cr is an element that improves hardenability, and has a property of achieving sufficient hardenability improving effect even in a small amount as compared with Ni. If the Cr content is less than 0.3%, the effect of improving strength by Cr is insufficient. Accordingly, in the case where the alloyed steel powder contains Cr, the Cr content is 0.3% or more. If the Cr content is more than 3.5%, a large amount of Cr oxide forms. Cr oxide serves as a fracture origin inside the sintered body, and causes a decrease in the strength of the sintered body. Moreover, if a large amount of Cr dissolves in the steel powder, the steel powder hardens due to the solid solution strengthening effect, and as a result the compressibility of the powder decreases. Accordingly, in the case where the alloyed steel powder contains Cr, the Cr content is 3.5% or less. To achieve higher compressibility and sintered body strength effectively, the Cr content is preferably 0.5% or more, and preferably 1.50% or less.

The balance of the alloyed steel powder other than the components described above consists of Fe and inevitable impurities. The amount of inevitable impurities is not limited as long as it is within a range of inevitable mixing, but is preferably controlled so that substantially no inevitable impurities will be contained. Ni causes an increase in alloy costs, and therefore the Ni content is preferably limited to 0.1% or less. Si is susceptible to oxidation and requires annealing atmosphere control, and therefore the Si content is preferably limited to 0.1% or less. It is preferable to limit C: 0.01% or less, O: 0.50% or less, P: 0.025% or less, S: 0.025% or less, N: 0.05% or less, and other elements: 0.01% or less.

The O content herein includes the amount of oxygen contained in particulate oxide that inevitably forms in the alloyed steel powder.

Total Amount ($Mn_{in\ oxide}$+$Cr_{in\ oxide}$) of Mn and Cr in Oxide: 0.15 Mass % or Less In the production of the alloyed steel powder, the alloying elements oxidize and oxide forms inevitably. In particular, Mn oxide and Cr oxide which are not reduced easily have high hardness, and thus not only decrease the compressibility of the powder but also hinder element diffusion during sintering. Mn oxide and Cr oxide as precipitates in the metallic microstructure form a fracture origin, thus causing a significant decrease in the strength of the sintered body. The total amount ($Mn_{in\ oxide}$+$Cr_{in\ oxide}$) of Mn and Cr in the oxide is therefore limited to 0.15 mass % or less with respect to 100 mass % of the alloyed steel powder. The total amount ($Mn_{in\ oxide}$+$Cr_{in\ oxide}$) of Mn and Cr in the oxide is preferably 0.10 mass % or less. The total amount ($Mn_{in\ oxide}$+$Cr_{in\ oxide}$) of Mn and Cr in the oxide may be 0.01 mass % or more. In the case where only one of Mn or Cr is present in the oxide, the total amount of Mn and Cr in the oxide corresponds to the amount of the one of Mn or Cr that is present in the oxide.

The total amount ($Mn_{in\ oxide}$+$Cr_{in\ oxide}$) of Mn and Cr in the oxide can be calculated as follows:

After the alloyed steel powder is subjected to dissolution extraction using Br methanol, an undissolved residue corresponding to oxide is collected using a filter. The undissolved residue corresponds to the oxide in the alloyed steel powder.

The collected undissolved residue is alkali fused by a $Na_2CO_3$ solution treatment, and then the amount of Mn and the amount of Cr are measured by ICP optical emission spectrometry.

The total amount of Mn and Cr in the oxide with respect to 100 mass % of the alloyed steel powder is calculated from the amount of the alloyed steel powder used in the test and the measured amount of Mn and amount of Cr.

Ratio (Number Ratio) of Particulate Oxide in Contact With Cu of FCC Structure to Particulate Oxide: 50% or More Particulate oxide that forms inevitably in metallic microstructure in production of an alloyed steel powder or the like basically has high hardness, and accordingly can not only decrease the compressibility of the powder but also hinder element diffusion during sintering and thus decrease the strength of the sintered body significantly. By causing Cu of soft FCC structure to precipitate so as to come into contact with the particulate oxide, the decrease in compressibility can be suppressed, and diffusion of Cu during sintering can facilitate the sintering. Hence, the number ratio of particulate oxide in contact with Cu of FCC structure to the particulate oxide is 50% or more. The number ratio is preferably 80% or more. The number ratio may be 100%.

The number ratio of particulate oxide in contact with Cu of FCC structure to the particulate oxide can be obtained by observing particulate oxide and a precipitate of Cu in a cross-section of the alloyed steel powder and calculating the ratio of the number of particles of particulate oxide in contact with Cu of FCC structure out of 100 or more particles of the particulate oxide. Cu of FCC structure need only be at least partially in contact with the particulate oxide, and the particulate oxide may be surrounded by Cu of FCC structure. In detail, the number ratio can be calculated in the following manner.

The oxide and the precipitate in the alloyed steel powder can be identified by mapping the distribution state in the cross-section of the alloyed steel powder by EDX (energy-dispersive X-ray analysis) element mapping using a scanning transmission electron microscope (STEM). The measurement method is as follows:

First, a thin-film sample for STEM observation is collected from the alloyed steel powder for powder metallurgy. The method of collection is not limited. For example, sampling using a focused ion beam (FIB) may be performed. To map Cu, Cr, and Mn in the collected thin-film sample, a mesh to which the thin-film sample is attached is preferably made of any other material such as W, Mo, or Pt.

Since a particularly fine precipitate is hard to be detected by mapping, a high-sensitivity EDX detector needs to be used. An example of a STEM equipped with such a detector is Talos F200X produced by FEI Company Japan Ltd. The observation region is adjusted as appropriate depending on the precipitate particle size. Preferably, at least the observation field contains 50 or more particles.

The distribution states of Mn, Cr, and O are simultaneously mapped by the foregoing method, and a part in which O and at least one of Mn and Cr gather is taken to be particulate oxide. Typically, particulate oxide is approximately circular and has a maximum length of 10 nm or more and 100 nm or less in an observation region. In view of this, at least 100 parts each having a maximum length of 10 nm or more and 100 nm or less are selected, and the ratio of the number of parts of particulate oxide in contact with Cu of FCC structure out of the at least 100 parts is calculated. Herein, a Cu precipitate is a part in which Cu gathers when the distribution state of Cu is mapped, and typically a part of the precipitate having a maximum length of less than 10 nm is Cu of BCC structure and a part of the precipitate having a maximum length of 10 nm or more is Cu of FCC structure. Typically, Cu of FCC structure is approximately circular in an observation region. The crystal structure of a Cu precipitate can be identified by performing TEM diffraction pattern analysis on the precipitate.

A production process for the alloyed steel powder according to one of the disclosed embodiments will be described below. The following will describe a production process using water atomization, although the production process for the alloyed steel powder according to one of the disclosed embodiments is not limited to such and the alloyed steel powder according to one of the disclosed embodiments may be produced by any other process.

An alloyed steel powder raw material powder (hereafter "raw powder") is produced from molten steel adjusted to a predetermined chemical composition, by water atomization. A raw powder after water atomization typically contains a large amount of water. Accordingly, the raw powder is dehydrated using filter cloth or the like, and then dried. After this, the raw powder is classified in order to remove coarse particles and foreign matter. The sieve opening in the classification is about 180 μm (80 mesh), and the raw powder that has passed through the sieve is used in the next step.

The raw powder after the sieving is subjected to a heat treatment (hereafter also referred to as "finish-reduction") mainly for the purpose of decarburization and deoxidation. Reducing gas is preferably used in the finish-reduction. For example, the finish-reduction can be performed in a hydrogen atmosphere. Water vapor may be introduced in the atmosphere to facilitate decarburization. The finish-reduction may be performed in a vacuum. This is advantageous in that oxidizable elements such as Cr and Mn are reduced easily.

In the finish-reduction, the temperature in a soaking zone after heating is preferably 800° C. or more and 1150° C. or less. If the temperature is less than 800° C., reduction is insufficient. If the temperature is more than 1150° C., the progress of sintering causes crushing performed after the finish-reduction to be insufficient. Since sufficient decarburization, deoxidation, and denitrification effects are achieved with a temperature of 1000° C. or less, the temperature is more preferably 800° C. or more and 1000° C. or less from the viewpoint of cost reduction.

To control the crystal structure of the Cu precipitate to be FCC structure, the cooling rate in a cooling process after the soaking is 20° C./min or less, and preferably 10° C./min or less. This can cause Cu of FCC structure to precipitate so as to come into contact with the particulate oxide, thus improving the compressibility of the alloyed steel powder. A sintering process for obtaining a sintered body involves a heat treatment at a temperature higher than or equal to the transformation temperature of the alloyed steel powder. Cu diffuses uniformly into the microstructure during this heat treatment, and effectively functions as a hardenability improving element in a cooling process after the sintering, with it being possible to obtain a high-strength sintered body. Although no lower limit is placed on the cooling rate in the cooling process after the soaking, the cooling rate may be 1° C./min or more from the viewpoint of easily preventing an increase in production costs caused by an increase in heat treatment time and an increase in grinding costs caused by excessive sintering.

In the case where the Cu precipitate does not coarsen sufficiently in the finish-reduction, the powder after the finish-reduction may be additionally subjected to a heat treatment (hereafter also referred to as "coarsening heat treatment") for the purpose of coarsening, to cause the Cu precipitate to be sufficiently in contact with the particulate oxide. The soaking temperature in such a heat treatment needs to be lower than or equal to the transformation temperature of the alloyed steel powder, in order to maintain the state in which Cu precipitates. Since the transformation temperature differs depending on the components of the alloyed steel powder, the soaking temperature is preferably adjusted depending on the components.

The powder after the finish-reduction or the coarsening heat treatment is in a state in which alloy particles cluster as a result of sintering. Hence, it is preferable to grind the powder and classify the powder into a particle size of 180 μm or less using a sieve, before the next step.

[Iron-Based Mixed Powder for Powder Metallurgy]

The alloyed steel powder itself may be used for powder metallurgy. Alternatively, an iron-based mixed powder for powder metallurgy (hereafter also referred to as "mixed powder") composed of the alloyed steel powder and a metal powder may be used for powder metallurgy. The metal powder in the mixed powder according to one of the disclosed embodiments is one or both of a Cu powder: more than 0% and 4% or less and a Mo powder: more than 0% and 4% or less. The chemical composition of the iron-based mixed powder for powder metallurgy is expressed with respect to 100 mass % of the iron-based mixed powder for powder metallurgy.

Cu Powder: More than 0% and 4% or Less

A Cu powder can facilitate sintering and improve the strength when added to the alloyed steel powder. If the content of the Cu powder is more than 4%, the amount of liquid phase formed during sintering increases, and the density of the sintered body decreases due to expansion, as a result of which the strength decreases. The amount of the Cu powder added is therefore 4% or less. In the case of adding the Cu powder, the amount of the Cu powder is preferably 0.5% or more, in order to improve the strength efficiently.

Mo Powder: More than 0% and 4% or Less

A Mo powder can facilitate sintering and improve the strength when added to the alloyed steel powder. If the content of the Mo powder is more than 4%, the alloyed steel powder hardens and the compressed density decreases, as a result of which the strength decreases. The amount of the Mo powder added is therefore 4% or less. In the case of adding the Mo powder, the amount of the Mo powder is preferably 0.5% or more, in order to improve the strength efficiently.

The method of producing the mixed powder is not limited, and the mixed powder may be produced by any method. For example, the mixed powder may be produced by mixing the alloyed steel powder with one or both of the Cu powder and the Mo powder in the foregoing content range. Any method may be used to mix these powders. Examples of mixing methods include use of a V-shaped mixer, a double-cone mixer, a Henschel mixer, a Nauta mixer, etc. When mixing the powders, a binder such as machine oil may be added to prevent segregation of one or both of the Cu powder and the Mo powder. Alternatively, the alloyed steel powder and one or both of the Cu powder and the Mo powder may be charged into a die for pressing in the foregoing content range to form the mixed powder.

[Sintered Body]

A sintered body can be produced from the alloyed steel powder or the mixed powder (hereafter also referred to as "raw material powder") as raw material. The method of producing the sintered body is not limited, and the sintered body may be produced by any method. For example, the sintered body may be produced by, after adding one or more optional components to the raw material powder as appropriate, pressing and then sintering them.

Optional Components

The foregoing raw material powder itself may be used as the raw material of the sintered body. Alternatively, auxiliary raw material such as a carbon powder may be used together with the raw material powder.

The carbon powder is not limited, but a graphite powder (natural graphite powder, artificial graphite powder, etc.) and carbon black are preferable. As a result of adding the carbon powder, the strength of the sintered body can be further improved. In the case of adding the carbon powder, the amount of the carbon powder is preferably 0.2 parts by mass or more and preferably 1.2 parts by mass or less with respect to 100 parts by mass of the raw material powder, from the viewpoint of the strength improving effect.

A lubricant may be added to the raw material powder. As a result of adding the lubricant, the green compact can be easily extracted from the die. The lubricant is not limited, and examples include metal soaps (zinc stearate, lithium stearate, etc.) and amide-based waxes (ethylenebisstearamide, etc.). The lubricant is preferably powdery. In the case of using the lubricant, the amount of the lubricant is preferably 0.3 parts by mass or more with respect to 100 parts by mass of the raw material powder. The amount of the lubricant is preferably 1.0 part by mass or less with respect to 100 parts by mass of the raw material powder.

A machinability improving powder may be added to the raw material. The machinability improving powder is not limited, and examples include a MnS powder and an oxide powder. In the case of using the machinability improving powder, the amount of the machinability improving powder is preferably 0.1 parts by mass or more with respect to 100 parts by mass of the raw material powder. The amount of the machinability improving powder is preferably 0.7 parts by mass or less with respect to 100 parts by mass of the raw material powder.

Pressing

After adding optional components such as the auxiliary raw material, the lubricant, and the machinability improving powder to the raw material powder as appropriate, the raw material powder, etc. are pressed in a desired shape to obtain a green compact. The pressing method is not limited, and any method may be used. For example, the raw material powder, etc. may be charged into a die and pressed. A lubricant may be applied or adhered to the die. In this case, the amount of the lubricant is preferably 0.3 parts by mass or more with respect to 100 parts by mass of the raw material powder. The amount of the lubricant is preferably 1.0 part by mass or less with respect to 100 parts by mass of the raw material powder.

The pressure when forming the green compact by the pressing may be 400 MPa or more and 1000 MPa or less. If the pressure is in this range, a decrease in the density of the green compact can be prevented, with it being possible to prevent a decrease in the density of the sintered body and insufficient strength of the sintered body. In addition, the load on the die can be reduced. The use of the raw material powder according to one of the disclosed embodiments enables, for example, production of a green compact having a density (compressed density) of 6.75 $Mg/m^3$ or more at a compaction pressure of 588 MPa. The density (compressed density) of the green compact is preferably 6.80 $Mg/m^3$ or more.

Sintering

The obtained green compact is then sintered. The sintering method is not limited, and any method may be used. The sintering temperature may be 1100° C. or more, and is preferably 1120° C. or more, from the viewpoint of sufficient progress of sintering. Since a higher sintering temperature contributes to a more uniform distribution of Cu and Mo in the sintered body, no upper limit is placed on the sintering temperature. From the viewpoint of reducing the production costs, however, the sintering temperature is preferably 1250° C. or less, and more preferably 1180° C. or less. Given that the raw material powder contains an alloyed steel powder obtained by alloying Cu, Mo, and Cr, the distribution of Cu, Mo, and Cr can be made uniform even with the foregoing range of the sintering temperature. Consequently, the strength of the sintered body can be improved effectively.

The sintering time may be 15 min or more and 50 min or less. If the sintering time is in this range, insufficient sintering and resulting insufficient strength can be prevented, and the production costs can be reduced. The cooling rate when cooling the sintered body after the sintering may be 20° C./min or more and 40° C./min or less. If the cooling rate is less than 20° C./min, quenching is insufficient, which can cause a decrease in tensile strength. If the cooling rate is 40° C./min or more, equipment for increasing the cooling rate is needed, causing an increase in production costs.

In the case of using the lubricant, a degreasing process of holding the green compact at a temperature of 400° C. or more and 700° C. or less for a certain time may be additionally performed to decompose and remove the lubricant before the sintering.

Other production conditions, equipment, and the like for the sintered body are not limited, and, for example, known production conditions, equipment, and the like may be used.

The obtained sintered body may be subjected to treatments such as carburizing-quenching and tempering.

EXAMPLES

The presently disclosed techniques will be described in more detail below by way of examples. The examples described below represent preferred examples of the present disclosure, and the present disclosure is not limited to such.

In each example, an alloyed steel powder and a sintered body using the alloyed steel powder were produced as follows:

Production of Alloyed Steel Powder

Molten steel having the chemical composition shown in Table 1 or Table 2 was adjusted and a raw powder was produced by water atomization. After dehydrating the raw powder using filter cloth, the raw powder was dried by a steam drier, and classified using a sieve with an opening of 180 μm to remove coarse particles and foreign matter. The amounts of Si, P, and S contained in the undersize raw powder as inevitable impurities were as follows: Si: less than 0.05 mass %, P: less than 0.025 mass %, and S: less than 0.025 mass %.

The undersize raw powder was subjected to finish-reduction. Specifically, in Nos. 19 and 22, the undersize raw powder was heated to 1150° C. at a heating rate of 10° C./min, and subjected to vacuum finish-reduction at 1150° C. for 60 min. In all samples other than Nos. 19 and 22, the undersize raw powder was heated to 1100° C. at a heating rate of 10° C./min, held in a hydrogen atmosphere at 1100° C. for 60 min, and subjected to finish-reduction.

After the finish-reduction, a heat treated body of particles in lump form as a result of sintering was ground using a hammer mill, classified using a sieve with an opening of 180 μm, and the undersize powder was collected and taken to be an alloyed steel powder. The amounts of C, O and N contained in the alloyed steel powder as impurities were as follows: C: less than 0.01 mass %, O: less than 0.40 mass %, and N: less than 0.05 mass %. The chemical composition of the alloyed steel powder was the same as the chemical composition of the foregoing molten steel.

The total amount ($Mn_{in\ oxide}$+$Cr_{in\ oxide}$) of Mn and Cr in oxide was calculated as follows:

After the alloyed steel powder was subjected to dissolution extraction using Br methanol, an undissolved residue corresponding to oxide was collected using a filter. The undissolved residue corresponds to the oxide in the alloyed steel powder.

The collected undissolved residue was alkali fused using a $Na_2CO_3$ solution, and then the amount of Mn and the amount of Cr were measured by ICP optical emission spectrometry.

The total amount of Mn and Cr in the oxide with respect to 100 mass % of the alloyed steel powder was calculated from the amount of the alloyed steel powder used in the test and the measured amount of Mn and amount of Cr.

After 0.5 g of the alloyed steel powder was subjected to dissolution extraction with 100 mL of Br methanol, an undissolved residue was collected using a polycarbonate Nuclepore membrane filter (produced by Whatman, pore size: 0.2 μm).

The collected undissolved residue was alkali fused using a $Na_2CO_3$ solution, and then the amount of Mn and the amount of Cr were measured by ICP optical emission spectrometry.

The total amount of Mn and Cr in the oxide with respect to 100 mass % of the alloyed steel powder was calculated from the amount of the alloyed steel powder used in the test and the measured amount of Mn and amount of Cr.

The ratio (number ratio, "ratio of particulate oxide in contact with Cu" in each table) of particulate oxide in contact with Cu of FCC structure to the particulate oxide was calculated as follows:

A thin-film sample for STEM observation was collected from the alloyed steel powder using a focused ion beam (FIB). A mesh to which the thin-film sample was attached was made of W. Talos F200X produced by FEI Company Japan Ltd. was used as a STEM. The observation was performed with 50 k magnification. The distribution states of Mn, Cr, and O were simultaneously mapped by element mapping, and a part in which O and at least one of Mn and Cr gathered was taken to be particulate oxide.

The distribution state of Cu was mapped, and a part having a high Cu concentration was taken to be a precipitate. A part having a maximum length of 10 nm or more was taken to be Cu of FCC structure, and the TEM diffraction pattern of the precipitate was examined to determine that Cu had FCC structure.

100 parts each having a maximum length of 10 nm or more and 100 nm or less are randomly selected from the particulate oxide, and the ratio of the number of parts of particulate oxide in contact with Cu of FCC structure out of the 100 parts was calculated.

Production Of Diffusion-Bonded Alloyed Steel Powder

A Cu powder (D50: approximately 30 μm) or an oxidized Mo powder (D50: approximately 3 μm) was added to the alloyed steel powder so that the content of Cu or Mo in the diffusion-bonded alloyed steel powder would be the value shown in Table 1, and mixed using a V-shaped mixer for 15 min. The mixture was then held in a hydrogen atmosphere at 1100° C. for 60 min and subjected to finish-reduction. After the finish-reduction, a reduced body of particles in lump form as a result of sintering was ground using a hammer mill, classified using a sieve with an opening of 180 μm, and the undersize powder was collected and taken to be a diffusion-bonded alloyed steel powder having Cu or Mo diffusion-bonded thereto. The amounts of C, O and N contained in the diffusion-bonded alloyed steel powder as impurities were as follows: C: less than 0.01 mass %, O less than 0.40 mass %, and N: less than 0.05 mass %.

Production of Sintered Body 0.8 parts by mass of a graphite powder, 0.6 parts by mass of a lubricant (zinc stearate), and a Cu powder (D50: approximately 45 μm) or a Mo powder (D50: approximately 25 μm) in the amount shown in Table 1 or Table 3 were added to 100 parts by mass of the alloyed steel powder or the diffusion-bonded alloyed steel powder, and mixed using a double-cone mixer to obtain an iron-based mixed powder. The iron-based mixed powder was compacted into a rectangular parallelepiped of 10 mm×10 mm×55 mm at a compaction pressure of 588 MPa to obtain a green compact. The density of the green compact was calculated by dividing the weight of the green compact by the volume of the rectangular parallelepiped.

The green compact was held in a 10% $H_2$-90% $N_2$ atmosphere at 1130° C. for 20 min to obtain a sintered body. A test piece of 50 mm in length and 3 mm in diameter was cut out of the sintered body, and the maximum stress before breaking (tensile strength) was measured.

Example 1

This example relates to an alloyed steel powder obtained by adding Cu, Mo, and one or both of Mn and Cr. The chemical compositions and the evaluation results are shown in Table 1. Herein, "-" in the chemical composition field denotes that the component was not added. The same applies hereafter.

As comparative examples, iron-based powders produced under the following eight conditions were also evaluated.

In No. 10, Cu was diffusion-bonded to the surface of an alloyed steel powder containing Mo and Mn as alloying elements, and the resultant powder was mixed with a graphite powder and a lubricant.

In No. 11, an alloyed steel powder containing Mo and Mn as alloying elements was mixed with a Cu powder, a graphite powder, and a lubricant.

In No. 12, Mo was diffusion-bonded to the surface of an alloyed steel powder containing Cu and Mn as alloying elements, and the resultant powder was mixed with a graphite powder and a lubricant.

In No. 13, an alloyed steel powder containing Cu and Cr as alloying elements was mixed with a Mo powder, a graphite powder, and a lubricant. The coating weights, the addition amounts, and the evaluation results are shown in Table 1.

In No. 23, Cu was diffusion-bonded to the surface of an alloyed steel powder containing Mo and Cr as alloying elements, and the resultant powder was mixed with a graphite powder and a lubricant.

In No. 24, an alloyed steel powder containing Mo and Cr as alloying elements was mixed with a Cu powder, a graphite powder, and a lubricant.

In No. 25, Mo was diffusion-bonded to the surface of an alloyed steel powder containing Cu and Cr as alloying elements, and the resultant powder was mixed with a graphite powder and a lubricant.

In No. 26, an alloyed steel powder containing Cu and Cr as alloying elements was mixed with a Mo powder, a graphite powder, and a lubricant.

The coating weights, the addition amounts, and the evaluation results are shown in Table 1.

TABLE 1

| | Alloyed steel powder*4 | | | | | | | | | | | | |
|---|---|---|---|---|---|---|---|---|---|---|---|---|---|
| | Chemical composition*1 (mass %) | | | | $Mn_{in\ oxide}$ + $Cr_{in\ oxide}$ | Ratio of particulate oxide in contact with Cu | Diffusion-bonded powder Coating weight*2 (mass %) | | Metal powder Addition amount*3 (mass %) | | Green compact Density | Sintered body Tensile strength | |
| No. | Cu | Mo | Mn | Cr | (mass %)*5 | (%) | Cu | Mo | Cu powder | Mo powder | ($Mg/m^3$) | (MPa) | Remarks |
| 1 | 2.0 | — | 0.1 | — | 0.02 | 80 | — | — | — | — | 7.11 | 473 | Comparative Example |
| 2 | 2.0 | 0.51 | 0.1 | — | 0.01 | 78 | — | — | — | — | 7.05 | 578 | Example |
| 3 | 3.0 | 0.51 | — | — | — | — | — | — | — | — | 7.04 | 579 | Comparative Example |
| 4 | 3.0 | — | 0.5 | — | 0.05 | 64 | — | — | — | — | 7.01 | 532 | Comparative Example |
| 5 | — | 1.20 | 0.5 | — | 0.10 | 0 | — | — | — | — | 6.97 | 632 | Comparative Example |
| 6 | 3.0 | 1.20 | 0.5 | — | 0.10 | 68 | — | — | — | — | 6.94 | 784 | Example |
| 7 | 8.0 | 1.20 | 0.5 | — | 0.10 | 76 | — | — | — | — | 7.01 | 778 | Example |
| 8 | 3.0 | 2.00 | 0.5 | — | 0.10 | 69 | — | — | — | — | 6.89 | 797 | Example |
| 9 | 3.0 | 1.20 | 1.0 | — | 0.15 | 53 | — | — | — | — | 6.89 | 738 | Example |
| 10 | — | 1.20 | 0.5 | — | 0.10 | 0 | 3.0 | — | — | — | 7.01 | 626 | Comparative Example |
| 11 | — | 1.20 | 0.5 | — | 0.10 | 0 | — | — | 3.0 | — | 7.00 | 618 | Comparative Example |
| 12 | 3.0 | — | 0.5 | — | 0.10 | 66 | — | 1.20 | — | — | 7.04 | 532 | Comparative Example |
| 13 | 3.0 | — | 0.5 | — | 0.10 | 67 | — | — | — | 1.20 | 7.06 | 521 | Comparative Example |
| 14 | 2.0 | — | — | 0.3 | 0.06 | 74 | — | — | — | — | 7.09 | 472 | Comparative Example |
| 15 | 2.0 | 0.51 | — | 0.3 | 0.06 | 72 | — | — | — | — | 7.01 | 577 | Example |
| 16 | 3.0 | 0.51 | — | — | — | — | — | — | — | — | 7.03 | 569 | Comparative Example |
| 17 | 3.0 | — | — | 1.2 | 0.08 | 65 | — | — | — | — | 7.00 | 523 | Comparative Example |
| 18 | — | 1.20 | — | 1.2 | 0.08 | 0 | — | — | — | — | 6.95 | 622 | Comparative Example |
| 19 | 3.0 | 1.20 | — | 1.2 | 0.08 | 62 | — | — | — | — | 6.93 | 775 | Example |
| 20 | 8.0 | 1.20 | — | 1.2 | 0.08 | 70 | — | — | — | — | 6.97 | 771 | Example |
| 21 | 3.0 | 2.00 | — | 1.2 | 0.08 | 67 | — | — | — | — | 6.86 | 788 | Example |
| 22 | 3.0 | 1.20 | — | 3.5 | 0.15 | 50 | — | — | — | — | 6.88 | 736 | Example |
| 23 | — | 1.20 | — | 1.2 | 0.08 | 0 | 3.0 | — | — | — | 6.98 | 622 | Comparative Example |
| 24 | — | 1.20 | — | 1.2 | 0.08 | 0 | — | — | 3.0 | — | 6.99 | 614 | Comparative Example |
| 25 | 3.0 | — | — | 1.2 | 0.08 | 0 | — | 1.20 | — | — | 7.02 | 531 | Comparative Example |
| 26 | 3.0 | — | — | 1.2 | 0.08 | 0 | — | — | — | 1.20 | 7.03 | 520 | Comparative Example |
| 27 | 2.0 | 2.00 | — | 3.5 | 0.15 | 45 | — | — | — | — | 6.72 | 545 | Comparative Example |
| 28 | 3.0 | 2.00 | 0.5 | 3.5 | 0.20 | 50 | — | — | — | — | 6.67 | 573 | Comparative Example |

*1balance of alloyed steel powder consisting of Fe and inevitable impurities
*2with respect to 100 mass % of total of alloyed steel powder and diffusion-bonded powder
*3with respect to 100 mass % of total of alloyed steel powder and metal powder
*4samples other than Nos. 19 and 22 being heated to 1100° C. at heating rate of 10° C./min, held in hydrogen atmosphere at 1100° C. for 60 min, and subjected to finish-reduction
Nos. 19 and 22 being heated to 1150° C. at heating rate of 10° C./min, held at 1150° C. for 60 min, and subjected to vacuum finish-reduction
*5with respect to 100 mass % of alloyed steel powder As can be understood from Table 1, in No. 2 containing Cu, Mo, and Mn, the tensile strength was markedly improved as compared with No. 1 containing only Cu and Mn. In No. 3 containing no Mn and containing an increased amount of Cu as compared with No. 2, the tensile strength was approximately equal to that in No. 2.

In No. 6 containing Cu, Mo, and Mn, the tensile strength was markedly improved as compared with No. 4 containing only Cu and Mn and No. 5 containing only Mo and Mn. In No. 7 containing an increased amount of Cu, No. 8 containing an increased amount of Mo, and No. 9 containing an increased amount of Mn as compared with No. 6, high tensile strength was maintained.

In each of Nos. 2 and 6 to 9 as Examples, $Mn_{in\ oxide}$+$Cr_{in\ oxide}$ was 0.15% or less and the ratio of particulate oxide in contact with Cu was 50% or more, indicating sufficiently high green compact density and excellent compressibility. The results of Nos. 5 to 7 demonstrate that the tensile strength can be improved by increasing the addition amount of Cu while maintaining high density.

The sintered body in No. 10 using a diffusion-bonded alloyed steel powder obtained by diffusion-bonding Cu to the surface of an alloyed steel powder containing Mo and Mn as alloying elements and the sintered body in No. 11 using a mixed powder obtained by mixing the same alloyed steel powder with a Cu powder were lower in tensile strength than the sintered body in No. 6 despite the contents of Cu, Mo, and Mn being the same. The sintered body in No. 12 using a diffusion-bonded alloyed steel powder obtained by diffusion-bonding Mo to the surface of an alloyed steel powder containing Cu and Mn as alloying elements and the sintered body in No. 13 using a mixed powder obtained by mixing the same alloyed steel powder with a Mo powder were lower in tensile strength than the sintered body in No. 6 despite the contents of Cu, Mo, and Cr being the same.

In No. 15 containing Cu, Mo, and Cr, the tensile strength was markedly improved as compared with No. 14 containing only Cu and Cr. In No. 16 containing no Cr and containing an increased amount of Cu as compared with No. 14, the tensile strength was lower than that in No. 14. In No. 19 containing Cu, Mo, and Cr, the tensile strength was markedly improved as compared with No. 17 containing only Cu and Cr and No. 18 containing only Mo and Cr. In No. 20 containing an increased amount of Cu, No. 21 containing an increased amount of Mo, and No. 22 containing an increased amount of Cr as compared with No. 19, high tensile strength was maintained.

Regarding compressibility, in each of Nos. 15 and 19 to 22 as Examples, $Mn_{in\ oxide}$+$Cr_{in\ oxide}$ was 0.15% or less and the ratio of particulate oxide in contact with Cu was 50% or more, indicating sufficiently high green compact density and excellent compressibility. The results of Nos. 18 to 20 demonstrate that the tensile strength can be improved by increasing the addition amount of Cu while maintaining high density.

The sintered body in No. 23 using a diffusion-bonded alloyed steel powder obtained by diffusion-bonding Cu to the surface of an alloyed steel powder containing Mo and Mn as alloying elements and the sintered body in No. 24 using a mixed powder obtained by mixing the same alloyed steel powder with a Cu powder were lower in tensile strength than the sintered body in No. 19 despite the contents of Cu, Mo, and Cr being the same. The sintered body in No. 25 using a diffusion-bonded alloyed steel powder obtained by diffusion-bonding Mo to the surface of an alloyed steel powder containing Cu and Cr as alloying elements and the sintered body in No. 26 using a mixed powder obtained by mixing the same alloyed steel powder with a Mo powder were lower in tensile strength than the sintered body in No. 19 despite the contents of Cu, Mo, and Cr being the same.

In No. 27, the ratio of particulate oxide in contact with Cu was less than 50%, so that the compressibility was low and the strength was low. In No. 28, $Mn_{in\ oxide}+Cr_{in\ oxide}$ was more than 0.15%, so that the compressibility was low and the strength was low.

Example 2

This example relates to an alloyed steel powder obtained by adding not only Cu, Mo, and Cr but also Mn as alloy components. The chemical compositions and the evaluation results are shown in Table 2.

TABLE 2

| | Alloyed steel powder | | | | | | | | |
|---|---|---|---|---|---|---|---|---|---|
| | Chemical composition*1 (mass %) | | | | $Mn_{in\ oxide}$ + $Cr_{in\ oxide}$ | Ratio of particulate oxide in contact with Cu | Green compact Density | Sintered body Tensile strength | |
| No. | Cu | Mo | Cr | Mn | (mass %)*2 | (%) | ($Mg/m^3$) | (MPa) | Remarks |
| 19 | 3.0 | 1.20 | 1.2 | — | 0.08 | 62 | 6.93 | 775 | Example |
| 29 | | | | 0.1 | 0.10 | 75 | 6.91 | 790 | Example |
| 30 | | | | 0.5 | 0.13 | 65 | 6.88 | 812 | Example |
| 31 | | | | 1.0 | 0.15 | 55 | 6.80 | 788 | Example |
| 32 | 3.5 | 1.20 | 1.5 | 1.1 | 0.15 | 50 | 6.72 | 726 | Comparative Example |
| 33 | 4.0 | 1.20 | 2.0 | 1.0 | 0.30 | 50 | 6.60 | 563 | Comparative Example |

*1balance consisting of Fe and inevitable impurities
*2with respect to 100 mass % of alloyed steel powder It can be understood from comparison between No. 19 and Nos. 29 to 31 that the tensile strength was further improved by using an alloyed steel powder containing a specific amount of Mn. Meanwhile, in No. 32 in which the addition amount of Mn did not satisfy the predetermined condition and No. 33 in which $Mn_{in\ oxide}+Cr_{in\ oxide}$ did not satisfy the predetermined condition, the tensile strength decreased.

Regarding compressibility, each of Nos. 29 to 31 as Examples had sufficiently high density and excellent compressibility.

Example 3

This example relates to a mixed powder obtained by adding a Cu powder and/or a Mo powder to an alloyed steel powder. The addition amounts of the alloyed steel powder, the Cu powder, and the Mo powder and the evaluation results are shown in Table 3.

TABLE 3

| | Mixed powder | | | Green compact Density | Sintered body Tensile strength | |
|---|---|---|---|---|---|---|
| | | Addition amount* (mass %) | | | | |
| No. | Alloyed steel powder | Cu powder | Mo powder | ($Mg/m^3$) | (MPa) | Remarks |
| 19 | No. 19 | — | — | 6.93 | 775 | Example |
| 34 | | 4 | — | 6.90 | 843 | Example |
| 35 | | 5 | — | 6.86 | 771 | Comparative Example |
| 36 | | — | 2 | 6.88 | 827 | Example |
| 37 | | — | 4 | 6.82 | 833 | Example |

TABLE 3-continued

| | Mixed powder | | | Green | Sintered body | |
|---|---|---|---|---|---|---|
| | | Addition amount* (mass %) | | compact Density | Tensile strength | |
| No. | Alloyed steel powder | Cu powder | Mo powder | ($Mg/m^3$) | (MPa) | Remarks |
| 38 | | — | 5 | 6.77 | 774 | Comparative Example |
| 39 | | 4 | 4 | 6.77 | 863 | Example |
| 40 | | 5 | 5 | 6.67 | 725 | Comparative Example |
| 30 | No. 30 | — | — | 6.88 | 812 | Example |
| 41 | | 4 | — | 6.87 | 869 | Example |
| 42 | | 5 | — | 6.85 | 804 | Comparative Example |
| 43 | | — | 2 | 6.87 | 865 | Example |
| 44 | | — | 4 | 6.80 | 862 | Example |
| 45 | | — | 5 | 6.79 | 820 | Comparative Example |
| 46 | | 4 | 4 | 6.77 | 901 | Example |
| 47 | | 5 | 5 | 6.75 | 770 | Comparative Example |

*with respect to 100 mass % of mixed powder

It can be understood from comparison between No. 19 and Nos. 34, 36, 37, and 39 and comparison between No. 30 and Nos. 41, 43, 44, and 46 that the tensile strength was further improved by mixing a specific amount of a Cu powder and/or a Mo powder. Meanwhile, in Nos. 35, 38, 40, 42, and 47 in which the mixing amount of the Cu powder and/or the Mo powder did not satisfy the predetermined condition, the tensile strength decreased. In No. 44, the tensile strength was approximately the same but the compressibility decreased.

Regarding compressibility, each of Nos. 34, 36, 37, 39, 41, 43, 44, and 46 as Examples had sufficiently high density and excellent compressibility.

The invention claimed is:

1. An alloyed steel powder for powder metallurgy, comprising:

Cu: 2.0 mass % or more and 8.0 mass % or less;

Mo: more than 0.50 mass % and 2.00 mass % or less;

Cr: 0.3 mass % or more and 3.5 mass % or less; and optionally, Mn: 0.1 mass % or more and 1.0 mass % or less, with a balance being Fe and inevitable impurities, wherein the alloyed steel powder contains particulate oxide, and a total amount of Mn and Cr in the particulate oxide is 0.15 mass % or less with respect to 100 mass % of the alloyed steel powder, and a number ratio of particulate oxide in contact with Cu of FCC structure to the particulate oxide is 50% or more.

2. An iron-based mixed powder for powder metallurgy, comprising:

the alloyed steel powder for powder metallurgy according to claim 1; and a metal powder, wherein the metal powder is one or both of a Cu powder: more than 0 mass % and 4 mass % or less and a Mo powder: more than 0 mass % and 4 mass % or less with respect to 100 mass % of the iron-based mixed powder for powder metallurgy.

3. A sintered body using the alloyed steel powder for powder metallurgy according to claim 1.

4. A sintered body using the iron-based mixed powder for powder metallurgy according to claim 2.

* * * * *